United States Patent [19]

Rada et al.

[11] 4,030,660

[45] June 21, 1977

[54] PARTITION ARRANGEMENT

[75] Inventors: Joseph J. Rada, Country Club Hills; Jeffrey M. Gardner, Wheaton, both of Ill.

[73] Assignee: Container Corporation of America, Chicago, Ill.

[22] Filed: Oct. 1, 1976

[21] Appl. No.: 728,512

[52] U.S. Cl. ..... 229/42; 229/15; 217/23

[51] Int. Cl.[2] ..... B65D 5/48

[58] Field of Search ..... 229/15, 42, 30; 217/23, 217/33

[56] References Cited

UNITED STATES PATENTS

| | | | |
|---|---|---|---|
| 782,544 | 2/1905 | Carrier | 229/15 X |
| 3,478,947 | 11/1969 | Schillinger | 229/15 |
| 3,963,169 | 6/1976 | Gardner | 229/15 X |

FOREIGN PATENTS OR APPLICATIONS

| | | | |
|---|---|---|---|
| 871,498 | 6/1961 | United Kingdom | 229/15 |
| 448,876 | 4/1968 | Switzerland | 229/15 |

*Primary Examiner*—Robert S. Ward, Jr.
*Attorney, Agent, or Firm*—Carpenter & Ostis

[57] ABSTRACT

A paperboard partition having a pair of U-shaped longitudinal sections separated by a multiply center transverse section.

2 Claims, 3 Drawing Figures

PARTITION ARRANGEMENT

SUMMARY OF THE INVENTION

The invention relates to partitions formed of paperboard or the like for use in shipping containers or with a plastic or film overwrap.

It is an object of the invention to provide a partition of the type described which is formed from a unitary blank of foldable paperboard, which is simple to assemble, and which is extremely rigid.

A more specific object of the invention is to provide, in a partition of the type described, a pair of longitudinal sections separated by an integral transverse section having an inner member with lateral projections sandwiched between portions of an outer member.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 2:
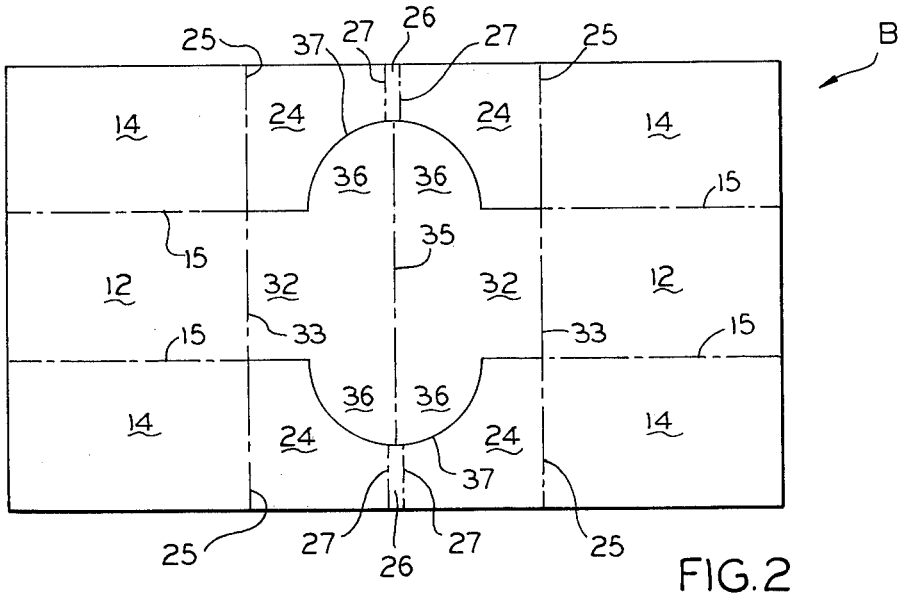
FIG. 2 is a plan view of a blank from which the partition illustrated in FIG. 1 may be formed.

Referring now to the drawings, it will be seen that the novel partition, indicated generally at P, embodying features of the invention, may be formed from a generally rectangular, unitary blank B of sheet material such as foldable paperboard, as illustrated in FIG. 2.

Partition P includes a pair of generally U-shaped, longitudinal sections 10 disposed in end-to-end relation with each other and separated from each other by an integral transverse section indicated generally at 20.

Each longitudinal section 10 includes a generally rectangular horizontal bottom panel 12 having foldably joined thereto at the side edges thereof along fold lines 15 and upstanding therefrom, a pair of opposed vertical panels 14.

The transverse section 20 includes a pair of outer members 22. Each outer member 22 includes a pair of vertical panels 24 foldably joined to the related edges of respective longitudinal member vertical panels 14 along fold lines 25. Panels 24 are disposed in parallel relationship and have their outer edges foldably joined to each other along fold lines 27 which define a narrow intermediate or hinge panel 26 therebetween. Transverse section 20 also includes an inner member 30 which includes a pair of vertical panels 32 which have their lower edges foldably joined along fold lines 33 to adjacent end edges of longitudinal member horizontal panels 12 and which are disposed in back-to-back relationship with their upper edges being foldably joined to each other along fold line 35.

Figure 3:
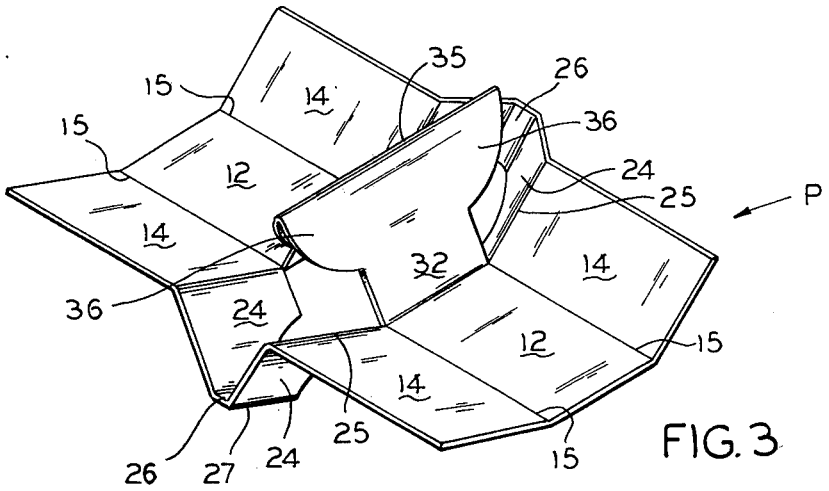
FIG. 3 is a perspective view of the partition in a partly erected condition illustrating the manner in which the partition is assembled.
Figure 1:
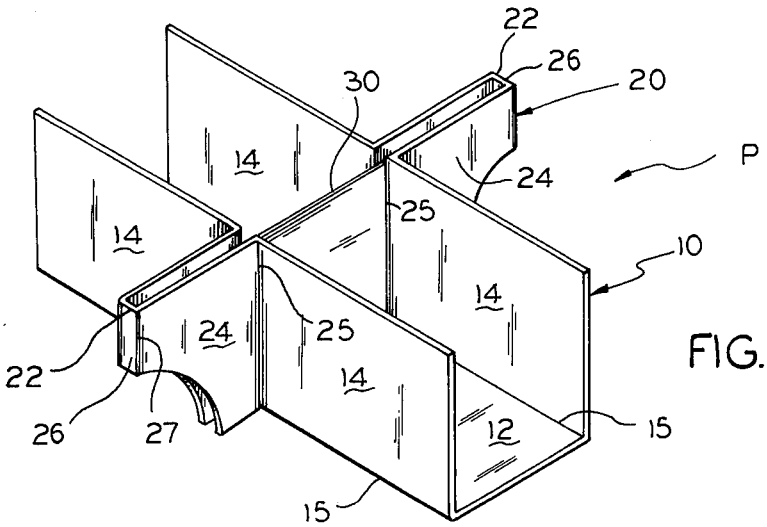
FIG. 1 is a perspective view of a partition embodying features of the invention, as shown in the fully erected condition.

It will be noted that each of the panels 32 of inner member 30 are provided with lateral extensions or wings 36 which are cut from the material of the blank used to form the outer member vertical panels. When the partition is erected the extensions 36 are, as best seen in FIGS. 1 and 3, interposed or sandwiched between the vertical panels of the transverse section outer members to provide additional strength and rigidity for the partition without requiring the use of additional material.

We claim:

1. In a multi-cell partition formed from a unitary blank of foldable sheet material such as paperboard, the combination of:

a. a pair of longitudinal sections disposed in end-to-end relation and each comprising a horizontal panel having joined to and upstanding from opposed side edges thereof a pair of vertical panels;

b. a transverse section lying in a vertical plane between said longitudinal sections and comprising:

i. a pair of outer members each including a pair of vertical panels foldably joined to and extending outboardly from related end edges of respective longitudinal section vertical panels and having outboard edges foldably joined to each other;

ii. an inner member including a pair of parallel vertical panels foldably joined to and extending upwardly from related end edges of respective longitudinal section horizontal panels and having upper edges joined to each other;

iii. said inner member vertical panels having extensions which project outboardly of said longitudinal section vertical panels and which are interposed between the respective outer member vertical panels to provide added strength for said partition.

2. A partition, according to claim 1, wherein said inner member vertical panel extensions are formed from material cut from said outer member vertical panels.

* * * * *